United States Patent [19]

Gocze

[11] Patent Number: 4,660,594

[45] Date of Patent: Apr. 28, 1987

[54] PORTABLE COLLAPSIBLE TANK FOR STORING LIQUID

[76] Inventor: Thomas E. Gocze, 360 Center St., Bangor, Me. 04401

[21] Appl. No.: 762,916

[22] Filed: Aug. 5, 1985

[51] Int. Cl.[4] ..... F16L 7/00

[52] U.S. Cl. ..... 137/375; 137/376; 251/144; 220/404; 220/451; 220/452; 220/902

[58] Field of Search ..... 137/375, 376, 381; 251/144; 220/403, 404, 450, 451, 452, 461, 462, 902

[56] References Cited

U.S. PATENT DOCUMENTS

| | | | |
|---|---|---|---|
| 1,947,835 | 2/1934 | Dubbs | 220/403 |
| 1,955,745 | 4/1934 | Hurley | 220/450 |
| 3,122,000 | 2/1964 | Sirocky | 220/452 |
| 3,406,858 | 10/1968 | Jackson | 220/462 |
| 3,489,311 | 1/1970 | Folkerts et al. | 220/450 |
| 3,760,971 | 9/1973 | Sterrett | 220/453 |
| 3,814,275 | 6/1974 | Lemons | 220/450 |
| 4,102,376 | 7/1978 | Sharp | 220/403 |
| 4,267,928 | 5/1981 | Curry, Jr. | 220/403 |
| 4,516,692 | 5/1985 | Croley | 220/403 |

*Primary Examiner*—Martin P. Schwadron
*Assistant Examiner*—Sheri M. Novack
*Attorney, Agent, or Firm*—Daniel H. Kane, Jr.

[57] ABSTRACT

A portable collapsible tank for storing and insulating hot water or other liquid is contained by an elongate flexible and foldable outer sleeve which defines the outer perimeter of the tank and is formed with sufficient tensile strength to support the tank and stored water. A side wall of insulating material is contained within the sleeve extending around the inside circumference of the sleeve from the top to the bottom of the tank. The outer sleeve and side wall layer overlap and frictionally engage the edge of a floor or base disk of rigid insulating foam material for stability of the tank without tilting and to prevent ballooning of an inner liner from the bottom of the tank. An inner liner of impervious flexible material suitable for contacting hot water, for example, for consumptive use is removeably seated within the side wall and base and extends over the top of the tank. A cover disk of insulating material engages the inner liner and side wall layer at the top of the tank to complete the insulating enclosure.

7 Claims, 9 Drawing Figures

PORTABLE COLLAPSIBLE TANK FOR STORING LIQUID

TECHNICAL FIELD

This invention relates to a new collapsible and portable tank for storing liquids and more particularly for storing and insulating heated water for domestic and consumptive uses produced by solar collectors or other alternative energy sources. The invention is also applicable for portable hot tubs and for storing cooled water as well as heated water.

BACKGROUND ART

Interest in alternative energy sources has resulted in growing numbers of solar collector installations, heat pumps, wood burning furnaces and boilers, etc., as sources of heat energy. Typically, heat energy is stored in heated water for subsequent use. An important component of such systems is therefore an insulated tank for example in the form of a 100-500 gallon (380-1,904 liter) metal tank wrapped with appropriate insulation or larger tanks built in place at the site. Such tanks add substantial expense to the system installation and are difficult to transport and locate in a building. For example, for a large tank, adequate clearance is necessary in entryways and frequently the tank cannot be installed at the preferred location.

OBJECTS OF THE INVENTION

It is therefore an object of the present invention to provide a new portable and collapsible tank, appropriate for storing water for domestic and consumptive uses, which is of lightweight construction and collapsible into separate elements for ease to transport to and assembly at a selected site.

Another object of the invention is to provide a tank collapsible into separate elements which is suitable for storing and insulating heated water or cooled water for a variety of uses.

A further object of the invention is to provide a portable hot water tank of lightweight elements and low-cost construction which can be assembled into the size range of, for example, 100-1500 gallons (380-5,714 liters).

DISCLOSURE OF THE INVENTION

In order to accomplish these results, the present invention provides a portable collapsible tank for storing hot water and other liquids using an elongate outer sleeve of flexible and foldable material for defining the side wall perimeter of the tank. The sleeve is formed with sufficient tensile strength for example from synthetic woven fabric, to support the tank and liquid stored in the tank.

A side wall layer of insulating material is contained within the sleeve extending around the inside circumference of the sleeve and from the top to the bottom of the tank. The sleeve and side wall layer of insulating material typically assume a cylindrical configuration.

The invention contemplates alternative arrangements for the side wall insulating material. For example, the side wall layer may consist of a plurality of elongate panels of structural or rigid wall foam insulation cut with complementary beveled side edges. The panels fit contiguously around the inside circumference of the sleeve providing the side wall insulation and also adding structural rigidity to the tank.

Alternatively, the side wall layer may comprise one or more sheets of foam insulation formed with a set of spaced slits to enable the sheet to bend and follow the inside contour of the sleeve. In the preferred example embodiment, at least two sheets of foam insulation provide the side wall with respective slits offset to avoid thermal short circuits. A reflective metallic layer such as a foil face provides further heat containment.

According to the invention a base floor such as a rigid foam disk is provided at the bottom of the tank. The outer sleeve and side wall layer of insulation overlap and frictionally engage the perimeter edge of the base floor or disk. A feature and advantage of this arrangement is that the snug frictional fit prevents an inner linear from ballooning out the bottom of the tank forming unwanted "aneurysms".

The flat rigid base and frictional fit of the outer sleeve and side wall around the edge of the base disk or floor balances the tank over the flat disk and further prevents tilting of the collapsible elements of the tank. A further feature and advantage of this construction and arrangement according to the present invention is that portable collapsible tanks can be constructed in which the height of the tank may be as great as twice the diameter of the tank or greater without imbalance and tilting which might otherwise occur.

An inner liner of impervious plastic sheet material which may be suitable for contacting water for domestic and consumptive use is seated within the side wall layer and base of insulating material. The inner liner extends over the side wall layer at the top of the tank. A cover of insulating material is seated within the side wall and frictionally engages the liner and side wall layer at the top of the tank. An opening for inlet and outlet pipes is provided in the cover of the tank for circulating liquid into and out of the inner liner.

In an alternative embodiment of the invention the side wall insulation is omitted, or soft insulation is used instead. Reinforcement is provided for forming the sleeve with a plurality of longitudinal pockets parallel with the axis of the sleeve for receiving batten elements such as, for example, plastic pipes. The battens extend substantially the length of the sleeve for longitudinal support and reinforcement. The inner liner may then bear directly against the outer sleeve in an uninsulated tank.

However, the construction of an insulated tank with a side wall layer and base of rigid insulating foam is sufficient according to the invention to support the tanks for storing heated water and liquid of substantial height in relation to diameter without imbalance or tilting and without additional support. The portable collapsible tank either insulated or uninsulated may be assembled within small spaces of a building where conventional metal tanks could not be located. Other objects, features and advantages of the invention are apparent in the following specification and accompanying drawings.

BRIEF DESCRIPTION OF THE DRAWINGS

FIG. 1 is an exploded perspective view of a preferred example embodiment of the portable collapsible tank while

FIG. 4 is a fragmentary cross section through the side wall of the assembled tank showing joining of the sleeve and liner at the top of the side wall while

DESCRIPTION OF PREFERRED EXAMPLE EMBODIMENTS AND BEST MODE OF THE INVENTION

Figure 1:
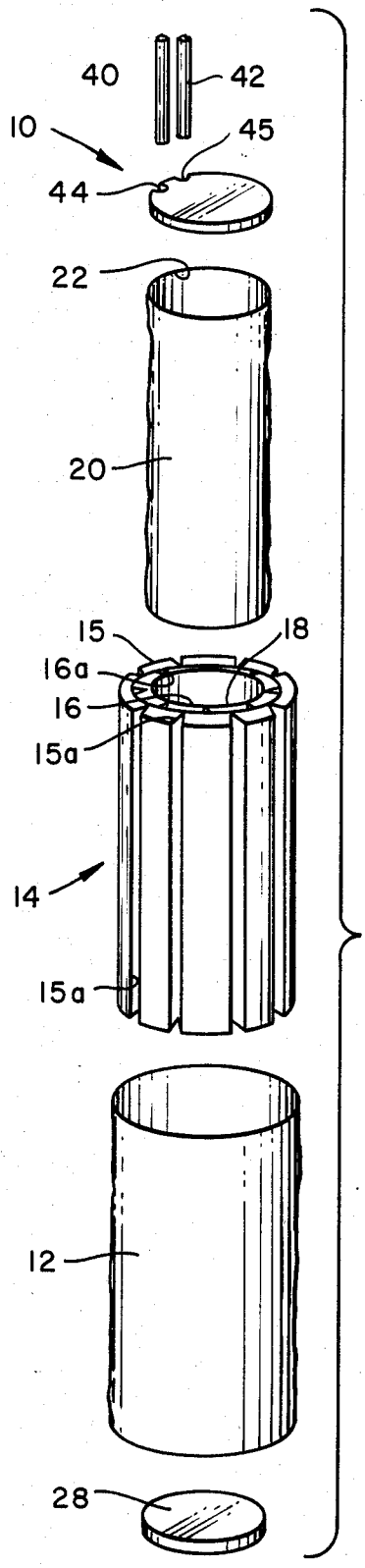
Figure 2:
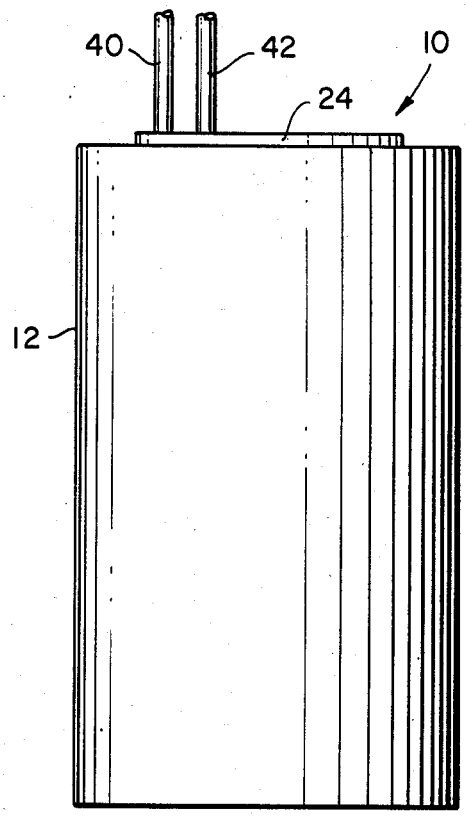
FIG. 2 is a side elevation view of the assembled tank.

In the embodiment of the present invention illustrated in FIGS. 1 and 2, the separable and collapsible elements of the tank 10 include the elongate outer sleeve 12 which defines the outer side wall perimeter of the tank 10. The sleeve 12 generally assumes a cylindrical configuration under the outward pressure of liquid stored in the tank and is formed with sufficient tensile strength to contain the tank and stored liquid. To this end sleeve 12 may be constructed for example of a woven synthetic fabric material such as vinyl-coated woven polyester fabric. Natural materials such as cotton duck may also be used but synthetic materials such as polyester on nylon are preferable because of resistance to rot. The outer sleeve, according to a typical example, may be for example 26 inches (66 cm) in diameter and 5 feet (152 cm) in height for accommodating a 100-gallon (380-liter) capacity tank.

Figure 5:
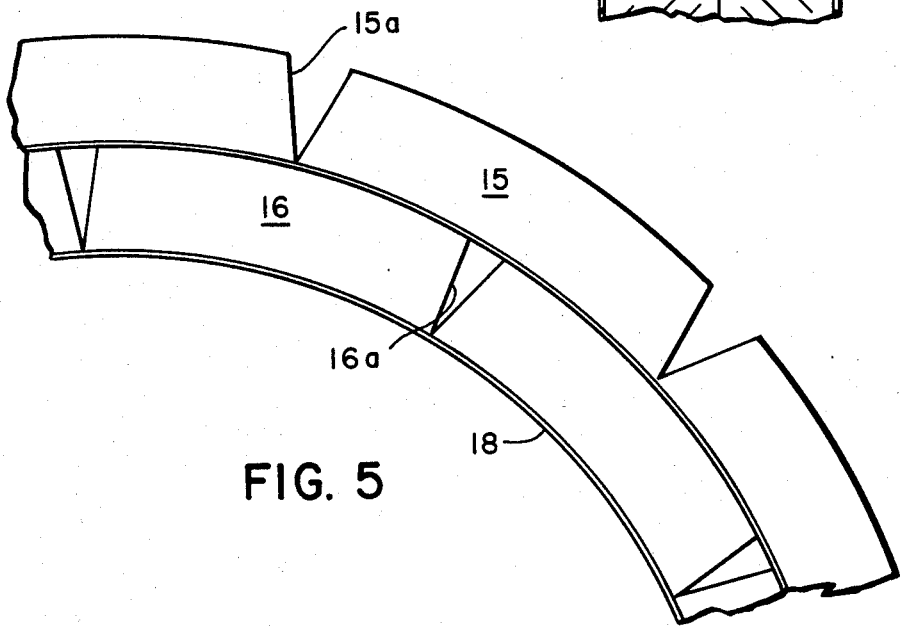
FIG. 5 is an enlarged fragmentary plan view from above showing a portion of the side wall layer composed of two sheets of foam with slits offset to avoid thermal short circuits.

Contained within the sleeve 12 is a side wall or layer 14 of insulating material which in this example is formed by two sheets 15 and 16 of foam insulation extending around the inside circumference of the sleeve and from the top to the bottom of the tank. The first sheet 15 is formed with a set of spaced apart slits 15*a* to allow the sheet 15 to bend and follow the inner contour of the sleeve 12. The second sheet 16 is also formed with a set of spaced apart second slits 16*a* to enable the second sheet 16 to bend and follow the contour of the first sheet 15. The second slits 16*a* and the second sheet 16 are offset from the first slits 15*a* of the first sheet 15 to avoid thermal short circuits as shown in further detail in FIG. 5.

The inside of the inner sheet 16 can be formed with a metal reflective face such as a foil face 18 to further reflect and contain energy within the tank. The foam sheets 15 and 16 are typically for example each 1 inch (2.5 cm) thick to provide a total of 2 inches (5 cm) side wall insulation. A Thermax (TM) type isocyanurate foam can be used by way of example for the sheets 15 and 16 formed with a foil face on each side of the sheet. It has been found that slits 15*a* and 16*a* can be formed every 3 inches (7.6 cm) extending through the foil face on one side and through the foam core of the sheet leaving in tact the remaining foil face which acts as a hinge, holding the elongate panels of foam together. The arrangement provides the desired flexibility or foldability of the sheets for accommodation within the sleeve 12.

The inner liner 20 is a pliable flexible impervious sheet of, for example, PVC plastic approved by the FDA for contact with heated water for domestic and consumptive uses. The inner liner 20 may be, for example, a seamless sheet which is seated and fitted inside the side wall 14 with the seamless sheet extending across the bottom with a skirt or edge 22 at the top which extends over and folds over the top of the side wall 14 for sealing engagement with a cover 24. The cover 24 is seated inside the top of the side wall 14 and inner liner 22 and frictionally engages the liner 22 and inside of the side wall 14 for sealing and heat confining enclosure of for example heated water stored in the tank. The cover 24 can be formed with a layer 25 of the FDA approved PVC liner material laminated over the inside face of the cover so that only FDA approved materials contact the liquid stored in the tank. The sheet material of the inner liner 20 is for example industrial drum liner gauge for heavy-duty durability.

The base or floor of the tank is provided by a bottom disk 28 of for example rigid styrofoam material 2 inches (5 cm) thick and for example 22 inches (56 cm) in diameter defining the inside diameter of the tank. The base disk 28 is inserted in a tight or snug frictional fit within the side wall 14 and outer sleeve 12 so that the side wall 14 and outer sleeve 12 slide over the outer edge of the base disk 28. As heretofore described, this affords the dual advantages of preventing aneurysms or ballooning of the liner 20 from the base of the tank under pressure of water or other liquid stored in the tank and furthermore substantially eliminates tilting of the tank. The stability afforded by the side wall and base construction according to the invention permits the construction of portable tanks with the collapsible elements as set forth in FIGS. 1 and 2 in configurations with the height as much as twice the diameter of the tank without imbalance and tilting for water tanks in the size range of for example 100–1500 gallons (380–5,714 liters), a height to width ratio not otherwise attainable with the lightweight, flexible and collapsible elements.

Figure 3:
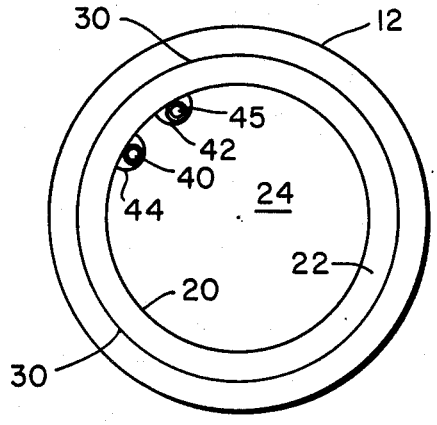
FIG. 3 is a plan view from above of the assembled tank.
Figure 4:
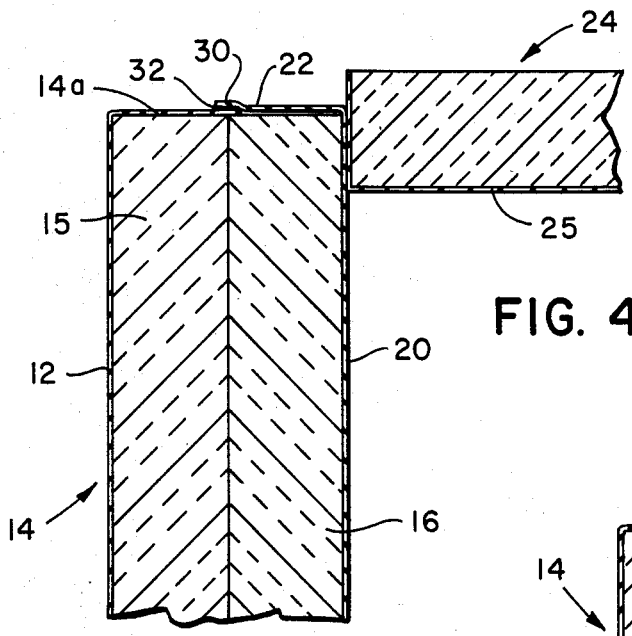
Figure 4A:
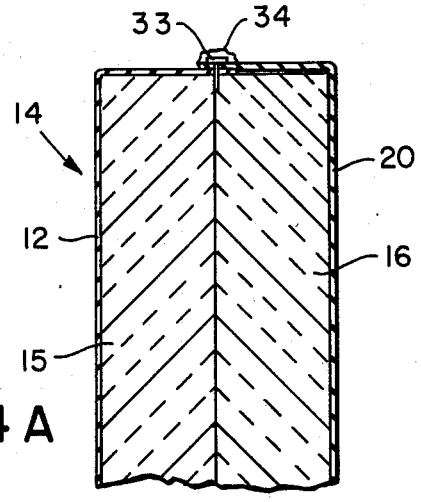
FIG. 4A is a fragmentary cross section through the side wall showing an alternative joinder of the sleeve and liner.

The tank is finished at the top of the side wall 14 as illustrated in FIGS. 3 and 4. The outer sleeve 12 overlaps the top of the side wall 14 and is turned inwardly so that it lies on the top 14*a* of the side wall 14. The upper edge or lip 22 of the inner liner 20 is then turned outwardly to lie over the sleeve 12 on the top edge 14*a* of the side wall 14. The lip 22 of liner 20 is then joined to the top of the outer sleeve to form a continuous seam 30 over the top edge 14*a* of side wall 14 around the upper perimeter of the tank 10. The continuous seam may be provided, for example, by a hot melt joint 32 applied by a heating glue gun. Alternatively, or in addition to the hot melt seam, tacks 33 can be applied through the overlapping layers of the liner and outer sleeve and into the insulating foam of the side wall 14. The tacks 33 can be covered with a coating 34 of the hot melt glue.

As shown in FIG. 4 the cover 24 is seated within and frictionally abuts the against the side wall 14. An impervious layer 25 of plastic material such as, for example, PVC sheet material approved by the FDA for contacting consumable liquid is bonded to the bottom surface and sides of the cover 24. The layer 25 may be formed of the same material as the liner 20, for example, 40 mil industrial gauge PVC molded to conform to the bottom and sides of the cover and bonded to the foam material of the cover with contact adhesive. Thus, as shown in FIG. 4, the bonded layer 25 on cover 24 and inner liner 20 press against each other at the top of the tank so that liquid in the tank is exposed to and contacts only FDA approved materials where the liquid may be used for human consumption or related purposes.

In order to accommodate inlet and outlet pipes 40 and 42 for circulating hot water to the tank from an energy source, indentations 44 and 45 are provided in the side of the cover 24 as illustrated in FIGS. 1 and 3. Once the tank is assembled, the cover or lid 24 may be caulked in place, for example, using silicone rubber glue at the inner face between the edge of the cover or lid 24 and the top of the side wall 14 to prevent loss of vapor from the heated liquid in the tank. To complete the seal the caulking material such as silicone rubber glue may also be applied at the indentations 44 and 45 around the inlet and outlet circulating tubes or pipes 40 and 42. A final installation of the tank may desirably include as many as five tubes or pipes not shown passing through the cover of the tank at further openings or indentations not shown. In addition to the inlet and outlet pipes 40 and 42 for circulating water from an energy source, heat exchanger inlet and outlet pipes, for example, may be provided to a coil of copper tubing positioned in the tank for circulating and heating water for domestic use. A dip tube or dipstick tube may also be added to allow access into the tank for a dipstick to check the level of liquid in the tank.

Figure 6:
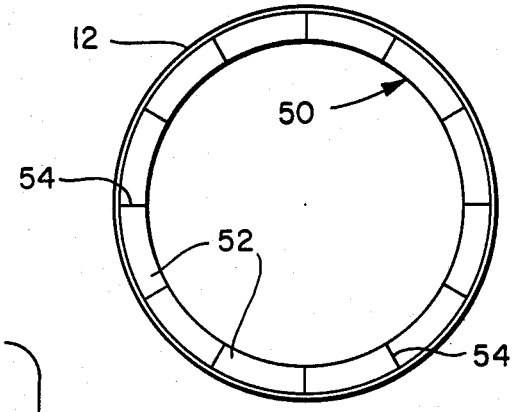
FIG. 6 is a plan view of an alternative side wall layer using elongate contiguous panels of rigid foam material with complementary bevelled edges for the side wall contained by the outer sleeve.

An alternative arrangement for the side wall of the tank is illustrated in the partial plan view of FIG. 6 showing only the outer sleeve 12 and an alternative side wall layer 50 of insulating material composed of elongate panels 52 of for example Thermax (TM) wall insulation. The elongate panels 52 form sectors or segments with beveled or radial cut side edges 54 which fit contiguously around the inside circumference of the sleeve 12. Each of the elongate panels 52 is for example 2 inches (5 cm) thick and approximately 6 inches (15 cm) wide. Each of the segments or sectors 52 is therefore substantially trapezoidal in cross section.

Figure 7:
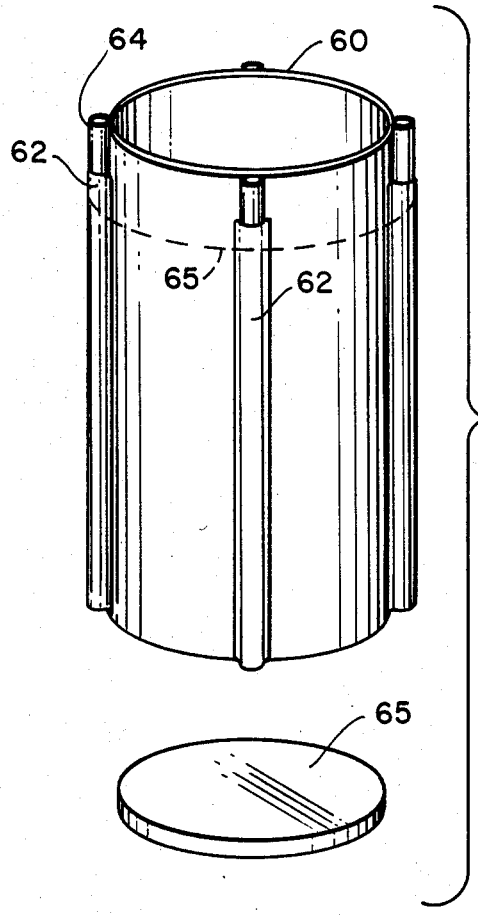
FIG. 7 is a fragmentary exploded perspective view of elements of another portable collapsible tank without insulation showing an alternate construction for the outer sleeve.
Figure 8:
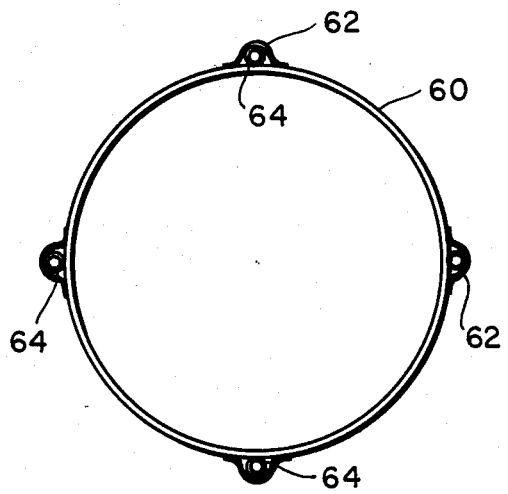
FIG. 8 is a plan view of the outer sleeve illustrated in FIG. 7 showing PVC pipe "battens" in place.

An alternative outer sleeve and an alternative uninsulated tank are illustrated in FIGS. 7 and 8. According to this example, the sleeve 60 is constructed in the same manner as the sleeve 12 of FIG. 1 except that elongate pockets 62 are formed in the sleeve for example around the outside of the sleeve to accommodate elongate batten members for longitudinal reinforcement of the tank. Batten members can be provided for example by plastic pipes 64 such as PVC plastic pipes extending substantially the length of the sleeve 60 from the top to the bottom of the tank. The batten pipes provide longitudinal stability either in addition to or instead of the structural support provided by the side wall insulating layers of FIGS. 1 and 3.

For an uninsulated tank the base disk 65 is provided similar to the bottom disk 28 of FIG. 1 but of sufficient diameter for tight frictional fit within the bottom of the sleeve 60. With no insulating side wall, an inner liner similar to the inner liner 20 of FIGS. 1 and 2 but the same diameter as sleeve 60 is seated within the batten pipe supported sleeve 60 and floor disk or base 65. The inner liner can extend above the top and be folded over to overlap the outside at a location, for example, as shown at 65 of FIG. 7. Further, the sleeve 60 of FIGS. 7 and 8 can be used with the portable collapsible tank of the type illustrated in FIGS. 1–3 to provide additional support and for use with nonstructural or amorphous side wall insulation layers such as batt, roll, or soft foam insulation where additional support from the batten pipes is necessary.

The portable and collapsible tank of the present invention can be used in a variety of applications and environments. For example, the tank structure alternative embodiments shown in the drawings can be used without the cover for a hot tub. By way of example, a 600 gallon hot tube may be constructed with dimensions of 5 feet (152 cm) in diameter and 4 feet (122 cm) in height. For such an application, for example, a polypropylene liner may be used instead of a PVC liner. Reinforcing straps are applied around the outside of the tank for reinforcement and greater integrity of the larger capacity larger diameter tub or tank.

While the invention has been described with reference to particular example embodiments, it is intended to cover all modifications and equivalents within the scope of the following claims.

I claim:

1. A portable, collapsible tank for storing liquid comprising:

an elongate flexible and foldable frameless outer sleeve open at each end and comprising woven fabric material, said outer sleeve defining the outer containment side wall perimeter of the tank, said sleeve being formed with sufficient tensile strength to support the tank and stored liquid without a rigid frame and without outer bands;

a side wall layer of insulating material contained within said sleeve extending around the inside circumference of the sleeve and from the top to the bottom of the sleeve, said side wall layer of insulating material also imparting vertical stability to the tank;

a base floor of insulating material, said sleeve and side wall layer overlapping and frictionally engaging the edge of said base floor;

an inner liner of impervious flexible material seated within the side wall layer and base floor, said inner liner extending over the side wall layer at the top of the tank;

a cover of insulating material for engaging the inner liner and side wall layer at the top of the tank; and inlet and outlet opening means at the top of the tank for circulating liquid into and out of the inner liner of said tank;

said tank being assembled without a rigid frame and without outer bands.

2. The tank of claim 1 wherein the side wall layer of insulating material is formed with at least one reflective metal foil face.

3. The tank of claim 1 wherein the sleeve comprises a synthetic woven fabric material.

4. The tank of claim 1 wherein the base floor comprises a styrofoam disk having a diameter defining the inner diameter of the tank, said side wall layer and sleeve fitting snugly over the edge of the styrofoam disk to prevent the inner liner from ballooning out the bottom.

5. The tank of claim 1 wherein the side wall layer comprises a first sheet of foam insulation extending around the inside circumference of the sleeve, said first sheet being formed with spaced apart first slits to enable the first sheet to bend and follow the contour of the sleeve, and a second sheet of foam insulation extending around the inside circumference of the first sheet, said second sheet being formed with spaced apart second slits to enable the second sheet to bend and follow the contour of the first sheet, said second slits in the second sheet being offset from the first slits of the first sheet to avoid thermal short circuits.

6. A portable collapsible tank for storing and insulating heated water comprising:

an elongate flexible, foldable and frameless outer sleeve of woven fabric material open at each end, said outer sleeve defining the outer containment side wall perimeter of the tank, said outer sleeve being formed with sufficient tensile strength to support the tank and store water without a rigid frame and without outer bands;

a side wall layer of insulating material contained within said sleeve and extending around the inside circumference of the sleeve from the top to the bottom of the tank, said side wall layer comprising a first sheet of foam insulation extending around the inside circumference of the sleeve, said first sheet being formed with spaced apart first slits to enable the first sheet to bend and follow the contour of the sleeve, and a second sheet of foam insulation extending around the inside circumference of the first sheet, said second sheet being formed with spaced apart second slits to enable the second sheet to bend and follow the contour of the first sheet, said second slits in the second sheet being offset from the first slits of the first sheet to avoid thermal short circuits, at least one of said first and second sheets being formed with a reflective metal face;

a base disk of rigid insulating foam material having a diameter defining the inside diameter of the tank, said outer sleeve and side wall layer overlapping and frictionally engaging the edge of the base disk for stable balancing of the tank without tilting and to prevent ballooning of an inner liner from the bottom of the tank;

an inner liner of impervious flexible material suitable for contacting hot water for domestic use, said inner liner being removably seated within the side wall layer and base disk and extending over the side wall layer at the top of the tank;

a cover disk of insulating material for engaging the inner liner and side wall layer at the top of the tank for insulating enclosure of heated water stored in the tank;

inlet and outlet opening means formed at the top of the tank for circulating liquid into and out of the inner liner of said tank and means for sealing the inlet and outlet opening means at the top of the tank to maintain said insulating enclosure for heated water stored in the tank;

said tank being collapsible into each of said separate specified elements for folding the outer sleeve and collapsing the side wall layer for portability and ease of assembly at a selected site, said tank being assembled without a rigid frame and without outer bands.

7. The tank of claim 6 wherein the height of the tank is substantially at least twice the diameter of the tank.

* * * * *